US006005475A

United States Patent [19]

Takasan et al.

[11] Patent Number: 6,005,475

[45] Date of Patent: Dec. 21, 1999

[54] COMMUNICATION METHOD AND APPARATUS FOR CONVEYOR CARRIAGES

[75] Inventors: Masaki Takasan; Yasuharu Odachi, both of Kariya, Japan

[73] Assignee: Kabushiki Kaisha Toyoda Jidoshokki Seisakusho, Aichi-ken, Japan

[21] Appl. No.: 08/925,346

[22] Filed: Sep. 8, 1997

[30] Foreign Application Priority Data

Sep. 9, 1996 [JP] Japan ..... 8-237732

[51] Int. Cl.[6] ..... H04B 1/00; B61L 1/00

[52] U.S. Cl. ..... 340/310.01; 340/310.07; 340/933; 340/941; 104/88.03; 246/166.1; 246/167 R; 246/187 R; 246/192; 191/2

[58] Field of Search ..... 340/310.01, 310.02, 340/425.1, 933, 941, 310.07; 455/3.1, 3.3; 375/257, 258, 259; 246/166.1, 167 R, 473 R, 8, 187 R, 192, 473 A; 104/88.02, 88.03; 191/2–7

[56] References Cited

U.S. PATENT DOCUMENTS

| | | | |
|---|---|---|---|
| 3,714,419 | 1/1973 | Fosse et al. | 340/310.01 |
| 3,942,168 | 3/1976 | Whyte | 340/310.01 |
| 4,008,467 | 2/1977 | Pattantyus-Abraham et al. | 340/310.01 |
| 4,032,911 | 6/1977 | Melvin, Jr. | 340/310.01 |
| 4,331,225 | 5/1982 | Bolger | 191/10 |
| 4,335,381 | 6/1982 | Palmer | 340/825.21 |
| 4,986,187 | 1/1991 | Booth et al. | 104/84 |
| 5,467,718 | 11/1995 | Shibata et al. | 104/284 |
| 5,539,296 | 7/1996 | Ito | 320/2 |
| 5,551,350 | 9/1996 | Yamada et al. | 104/293 |
| 5,555,815 | 9/1996 | Young et al. | 104/296 |
| 5,619,078 | 4/1997 | Boys et al. | 370/85 |
| 5,622,339 | 4/1997 | Capan | 246/194 |
| 5,628,478 | 5/1997 | McConnel et al. | 246/194 |
| 5,709,291 | 1/1998 | Nishino et al. | 191/10 |

FOREIGN PATENT DOCUMENTS

| | | |
|---|---|---|
| 5-207606 | 8/1993 | Japan . |
| 5-344603 | 12/1993 | Japan . |
| 6153305 | 5/1994 | Japan . |
| 08072709 | 3/1996 | Japan . |

*Primary Examiner*—Donnie L. Crosland
*Attorney, Agent, or Firm*—Morgan & Finnegan, L.L.P.

[57] ABSTRACT

A communication system for a plurality of carriages that travel along a rail. A power cable extends along the rail. The cable is used to convey electric current that drives the movable bodies and is also used to carry information between the carriages. The carriages communicate with one another by superimposing communication signals on the current flowing through the cable to transmit information and by extracting communication signals from the current flowing through the cable to receive information. A control unit at a fixed station relays communication signals transmitted between different carriages. The control unit receives communication signals, which the carriages transmit, from the cable, amplifies the signals, and returns the signals to the cable. The recipient carriage receives an amplified communication signal from the cable.

13 Claims, 7 Drawing Sheets

COMMUNICATION METHOD AND APPARATUS FOR CONVEYOR CARRIAGES

BACKGROUND OF THE INVENTION

The present invention relates to a method and system for communication between a plurality of carriages that travel along rails. More particularly, the present invention pertains to a method and system for performing communication by superimposing signals on electric current that flows through a power cable extended along rails.

In the prior art, a monorail type carriage (movable body) that travels along a rail, which is hung from a ceiling of a factory or a storehouse, to transfer articles between stations is known. Japanese Unexamined Patent Publication No. 6-153305 describes a system for supplying electric power to such a carriage. In the system, a pickup coil provided on the carriage is opposed to a power cable, which extends along a rail, in a non-contacting state. The pickup coil generates induced electromotive force from the alternating current that flows through the cable. The induced electromotive force is supplied to the carriage and used as the electric power that drives the carriage.

More specifically, as shown in FIG. 9, an alternating current of a certain voltage (e.g., 200V) flows through two cables 53 that are supported along a rail 51 by a supporter 52. A carriage obtains electric power through a pickup coil 54 opposed to the two cables 53. The pickup coil 54 includes an E-shaped core 55, a projection 55*a* projecting from the core 55, and a coil 56 wound about the projection 55*a*.

The carriage (local station) communicates with a fixed station (key station) located on the ground. The operation of the carriage is controlled by command signals sent from the fixed station. Communication between the fixed station and the carriage may be obstructed by crosstalk when employing a wireless system. Thus, a trolley wire extended along the rails is normally used for communication between the fixed station and the carriage. However, abrasion tends to occur on the trolley wire where it contacts a collecting brush. Furthermore, the wiring of the trolley wire is burdensome.

To solve such problems, the assignee of this application has employed the power cables for communication. As shown in FIG. 10, alternating current supplied by a high frequency power source 62 flows through the cables 53, which are arranged along the rail 51. A carriage 61 travels on the rail 51. Communication signals are superimposed on the alternating current flowing through the cables 53 by transmission antenna coils 64 provided on the fixed station 63. A communication antenna coil 65 (refer to FIG. 11(*b*)) is wound about a core 66 on each carriage 61. This structure enables communication between the carriage 61 and the fixed station 63.

As shown in FIG. 10, when a plurality of carriages 61 travel along the rail 51, collisions between the carriages 61 must be avoided. Collisions may be avoided by installing a sensor on each carriage 61 to detect objects located in front of the carriage 61 with respect to its moving direction. However, at curved portions of the rail 51, an object in front of the carriage 61 may not be detected until the carriage 61 is in close proximity to the object. In such cases, it may be too late to prevent collision when the object is detected. Therefore, communication is carried out between carriages 61 to confirm the location of other carriages 61 and avoid collisions.

As shown in FIG. 11(*a*), the antenna coils 64 are directly wound about the cables 53 at the fixed station 63. This decreases leakage flux and minimizes signal attenuation.

However, the antenna coil 65 of the carriage 61 cannot be directly wound about the cables 53 since the carriage 61 must travel along the cables 53. Therefore, as shown in FIG. 11(*b*), the antenna coil 65 is wound about the core 66, which is arranged in the vicinity of the cables 53.

The arrangement of the antenna coil 65 in the vicinity of the cables 53 increases flux leakage and signal attenuation in comparison to directly winding the coil 65 about the cables 53. Hence, in a case such as that shown in FIG. 12, a signal (frequency fO) superimposed on the alternating current, which flows through the cables 53, and transmitted from carriage M to carriage N is weakened by the signal attenuation that takes place when the signal is transferred from the antenna coil 65 of the carriage 61 denoted as M to the cables 53. The signal is further weakened when transferred from the cables 53 to the antenna coil 65 of the carriage 61 denoted as N. This results in poor reliability of communication between carriages 61. Additional attenuation of the signals takes place, especially when using a long rail 51, when the signal transmission distance between carriages 61 is great. This may cause erroneous signals to be received by the recipient carriage 61 and stop the entire system or cause other problems.

SUMMARY OF THE INVENTION

Accordingly, it is an objective of the present invention to provide a communication method and communication system for carriages that enhances the reliability of communication.

To achieve the above objective, the present invention provides a communication system for a plurality of movable bodies that travel along a rail. The communication system includes a cable extended along the rail. The cable is used to convey electric current that drives the movable bodies and is used for carrying information between the movable bodies. The movable bodies communicate with one another by superimposing communication signals on the current flowing through the cable to transmit information and by extracting communication signals from the current flowing through the cable to receive information. A fixed station relays communication signals between different ones of the movable bodies by amplifying communication signals received by the fixed station from the cable.

Other aspects of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 11(*b*) is a schematic view showing the antenna coil of the prior art carriage.

DETAILED DESCRIPTION OF THE PREFERRED EMBODIMENTS

One embodiment according to the present invention will now be described with reference to the FIGS. 1 to 8.

Figure 6:
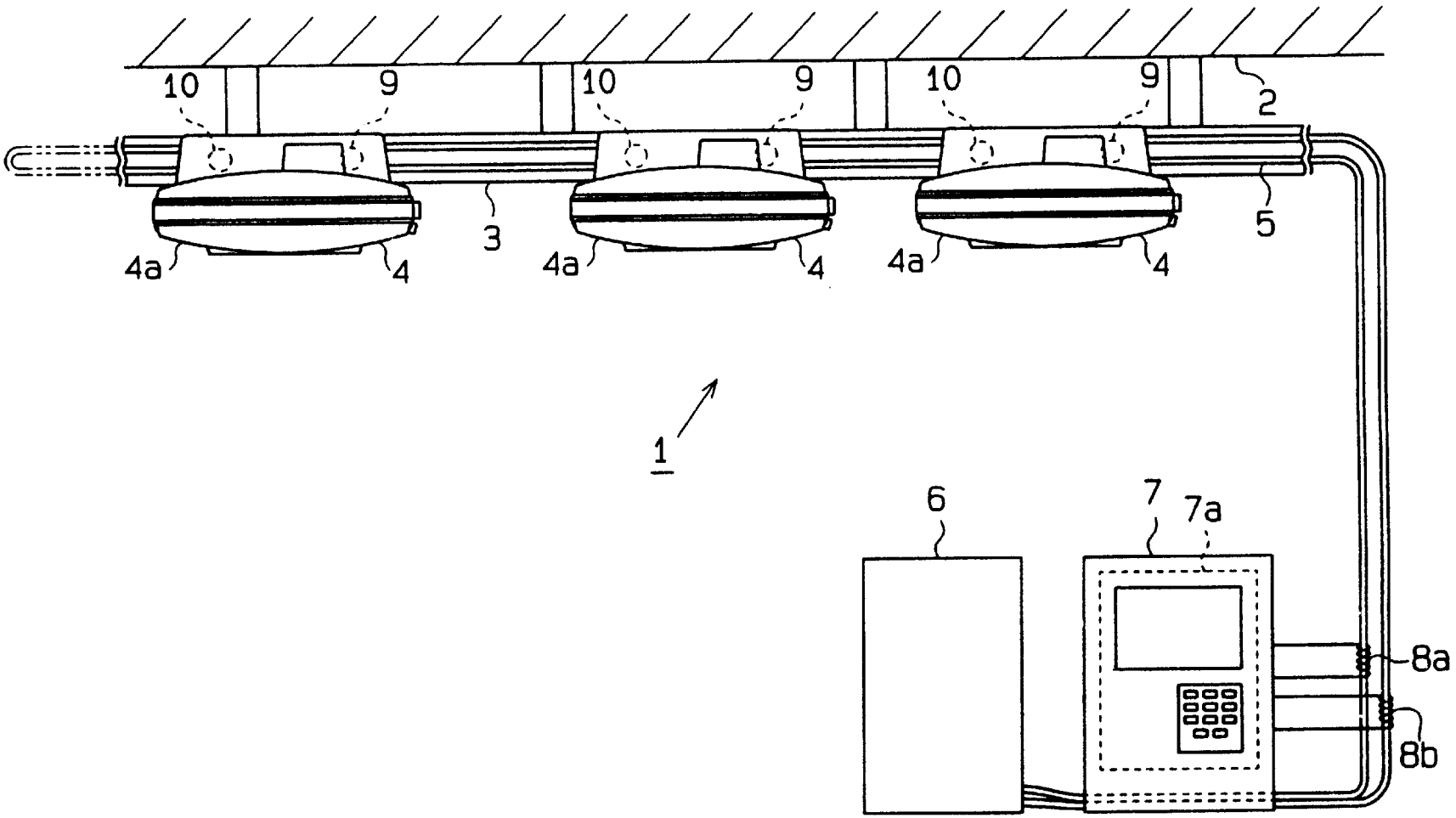
FIG. 6 is a partial side view showing the transport system.

FIG. 6 shows a transport system 1 to which the communication system according to the present invention is applied. As shown in the drawing, a plurality of carriages 4, or movable bodies, travel along a rail 3, which is hung from a ceiling 2. A power cable 5, which supplies electric power to the carriages 4, extends along the rail 3. The cable 5 is bent into two legs. The two legs extend parallel to each other with a predetermined interval in between. The ends of the cable 5 are connected to an electric power source 6 located on the ground. A control unit 7 is also arranged on the ground to control the operation of the carriages 4. The control unit 7 serves as a fixed station that communicates with the carriages 4 and includes a controller 7*a*. The controller 7*a* serves as a determining means and a demanding means. A transmission antenna coil 8*a* and a receptor antenna coil 8*b* are provided on the controller 7*a*. Each antenna coil 8*a*, 8*b* is directly wound about the cable 5 extending from the end of the rail 3.

Figure 7:
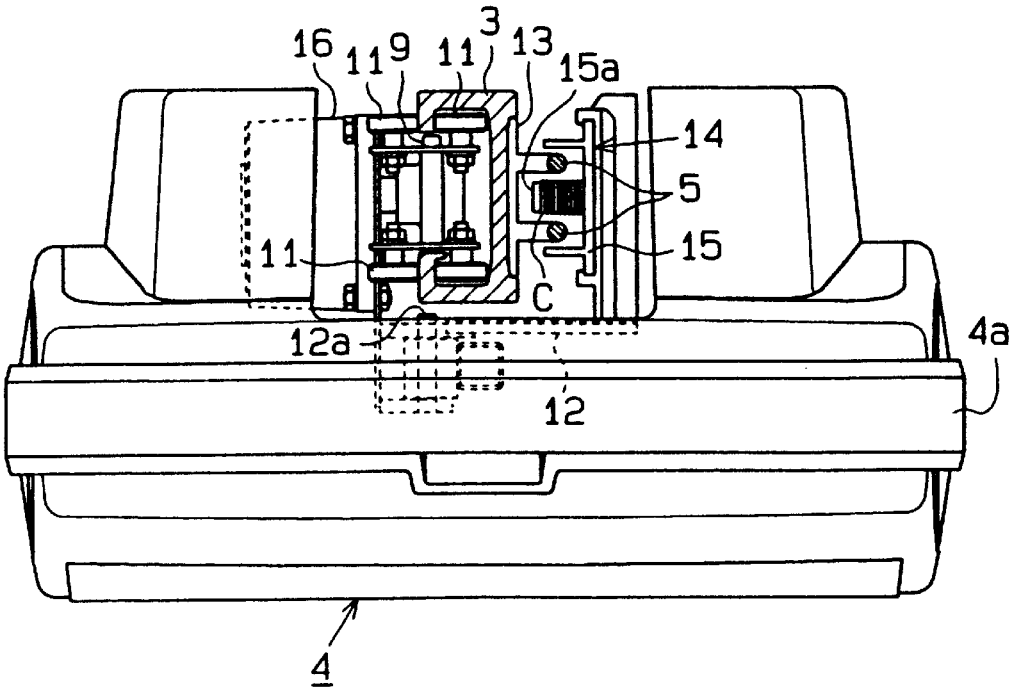
FIG. 7 is a front view showing the carriage.

Each carriage 4 has a front drive wheel 9 and a rear driven wheel 10. As shown in FIG. 7, the carriage 4 also has a plurality of guide wheels 11. The guide wheels 11 are arranged to hold the rail 3 between them. This restricts lateral swaying of the carriage 4. The carriage 4 has a body 4. Front and rear steering units 12 are provided on the upper part of the body 4*a*. Each steering unit 12 is rotatable about a shaft 12*a*. The wheels 9, 10, 11 are supported on the steering units 12 and steered along the rail 3.

A plurality of supporters 13 are fixed at spaced intervals to the rear side of the rail 3 (toward the right as viewed in the FIG. 7). The cable 5 extends along the rail 3 supported by these supporters 13.

In each carriage 4, a pickup apparatus 14 is supported on each steering unit 12 and is opposed to, without contacting, the cable 5. The pickup apparatus 14 includes a ferrite core 15 having a E-shaped cross-section, a projection 15*a* projecting from the ferrite core 15, and a coil C wound about the projection 15*a*. The coil C is arranged between the two legs of the cable 5. A motor 16 is provided on the steering unit 12 to rotate the drive wheel 9.

Figure 8:
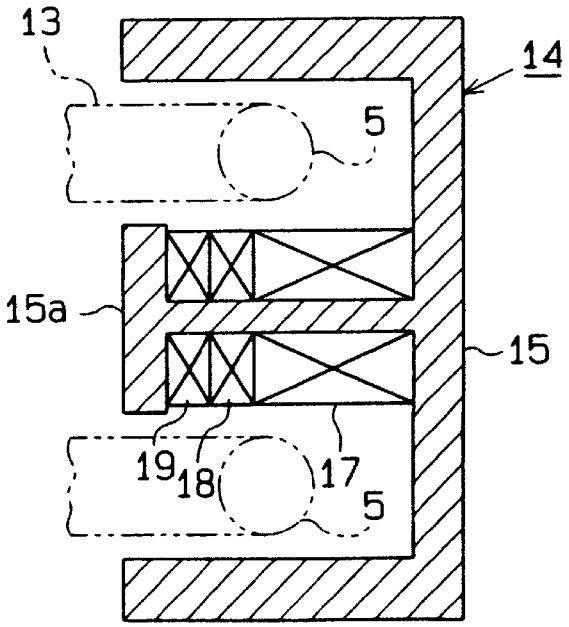
FIG. 8 is a schematic cross-sectional view showing the pickup apparatus.
Figure 9:
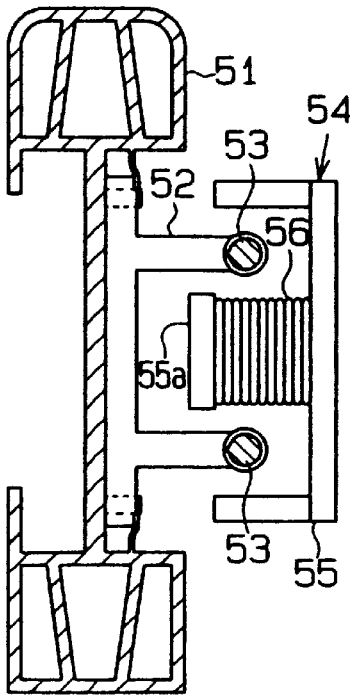
Fig.9(Prior Art)
FIG. 9 is a cross-sectional view showing the non-contact electric power supplying apparatus employed in the prior art.
Figure 10:
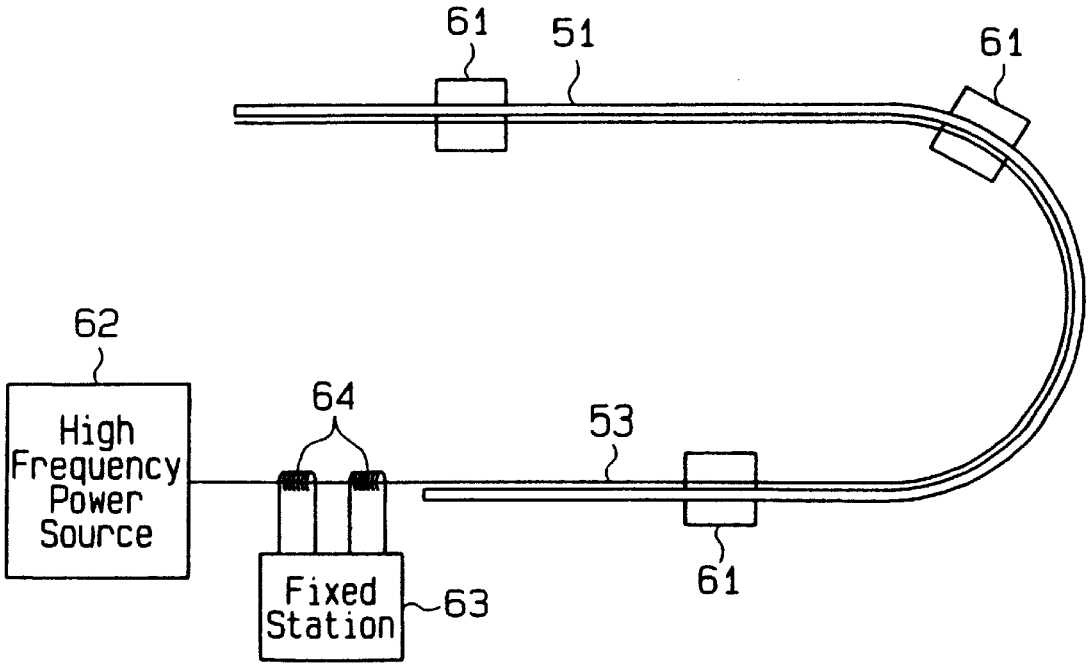
Fig.10(Prior Art)
FIG. 10 is a schematic view showing one apparatus for communication using superimposed signals.
Figure 11A:
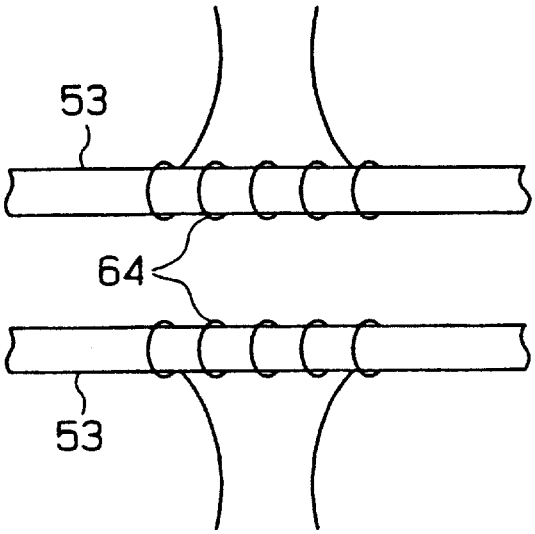
Fig.11(a) (Prior Art)
FIG. 11(*a*) is a schematic view showing the antenna coil of the prior art fixed station.
Figure 11B:
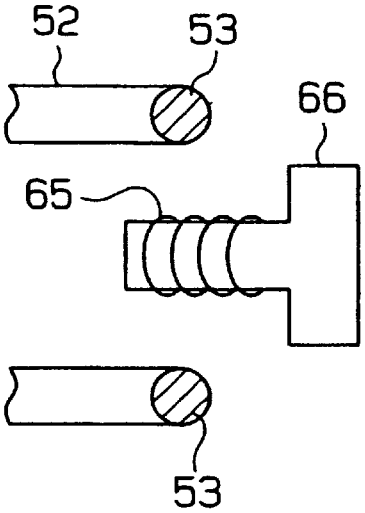
Fig.11(b) (Prior Art)
Figure 12:
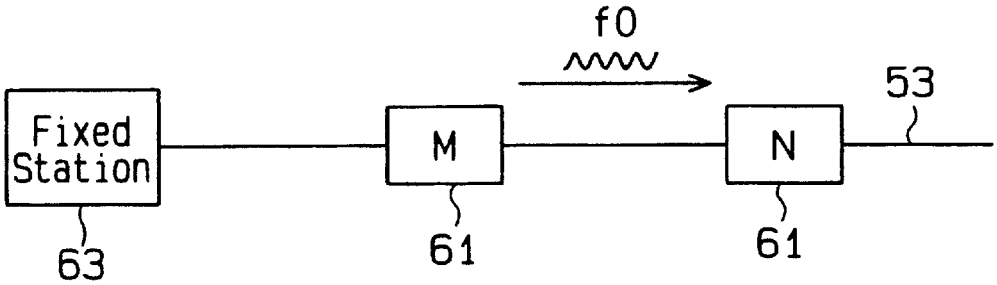
Fig.12(Prior Art)
FIG. 12 is a schematic view illustrating communication between carriages in the prior art.

As shown in FIG. 8, the coil C wound about the projection 15*a* of the ferrite core 15 includes a feeder coil 17, a transmission antenna coil 18, and a receptor antenna coil 19. The coils 17, 18, 19 are arranged orderly and axially along the projection 15*a* of the ferrite core 15. The coils 17, 18, 19 may be wound in any appropriate manner. For example, the coils 17, 18, 19 may be wound about the projection 15*a* in three layers. The transmission antenna coil 18 is preferably arranged closer to the cable 5 than the receptor antenna coil 19. In each carriage 4, the feeder coil 17, the transmission antenna coil 18, and the receptor antenna coil 19 of the front pickup apparatuses 14 are connected in series with the corresponding coil 17, 18, 19 of the rear pickup apparatus 14.

Figure 1:
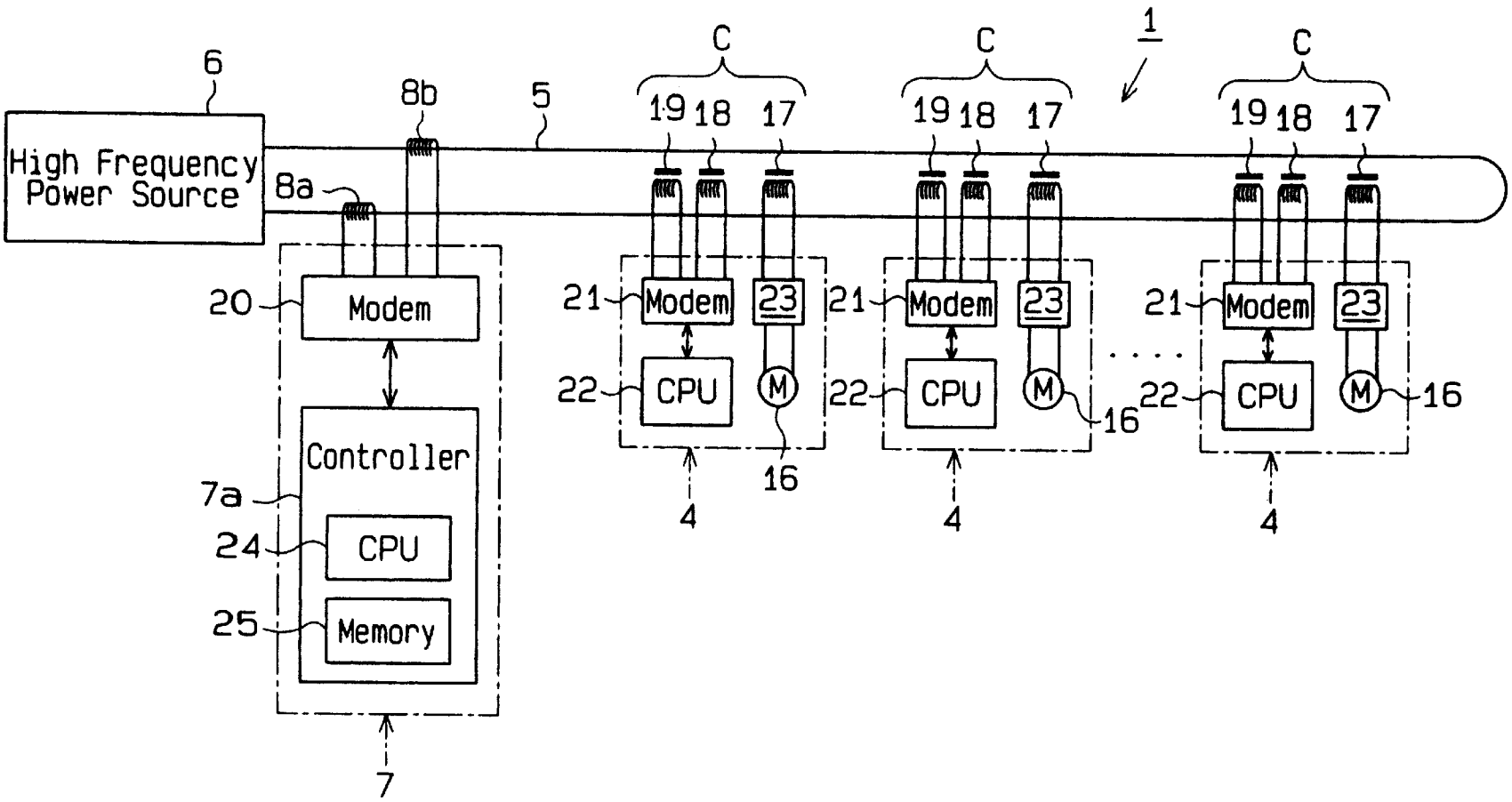
FIG. 1 is a diagrammatic view showing the electric structure of a transport system according to one embodiment of the present invention.

FIG. 1 shows the electric structure of the transport system 1. As shown in the drawing, the electric power source (high frequency) 6 is connected to both ends of the cable 5. The power source 6 supplies the cable 5 with an alternating current of, for example, 200V and 10 kHz. In the control unit 7, the controller 7*a* is connected to the transmission antenna coil 8*a* and the receptor antenna coil 8*b* by means of a modem 20, which serves as a converting means. The modem 20 converts digital signals, which are sent from the controller 7*a*, to alternating current having a predetermined frequency f2 and sends the frequency f2 current to the transmission antenna coil 8*a*. The modem 20 also filters the alternating current induced by the receptor antenna coil 8*b* to extract signals having frequency f1, which are superimposed on the current. The extracted signals are then digitized and sent to the controller 7*a*. Command signals transmitted to the carriages 4 are produced in accordance with the controller 7*a* based on operation command data, which is input into an input apparatus (not shown) provided at certain stations, operation information, which is obtained through communication with the carriages 4, and other information.

Each carriage 4 is provided with a modem 21 that is connected to the transmission antenna coil 18 and the receptor antenna coil 19. The modem 21 is connected to a central processing unit (CPU) 22 arranged on a mother board (not shown) incorporated in the body 4*a*. The modem 21 functions in the same manner as the modem 20 of the control unit 7. That is, the modem 21 converts digital signals sent from the CPU 22 to alternating current having a predetermined frequency f1 and sends the frequency f1 current to the transmission antenna coil 18. The modem 21 also extracts the signals having frequency f2 from the alternating current induced by the receptor antenna coil 19. The extracted signal is then digitized and sent to the CPU 22. The CPU 22 controls the carriage 4. Accordingly, communication is carried out between the control unit 7 and the carriage 4 by way of the cable 5. The operation of the carriage 4 is controlled by command signals sent from the control unit 7.

Each carriage 4 has an electric power source circuit 23 that is connected to the feeder coil 17. The power source circuit 23 rectifies the alternating current induced by the feeder coil 17. The power source circuit 23 also reduces the voltage of the alternating current to a predetermined value and then sends the alternating current to the motor 16 and the CPU 22.

The frequency f1 signals sent from each carriage 4 to the control unit 7 differ from the frequency f2 signals sent from the control unit 7 to each carriage 4. Communication of the control unit 7 with the carriages 4 and communication between the carriages 4 are carried out by superimposing the frequency f1 and f2 signals on the high frequency current (e.g., 10 kHz) flowing through the cable 5. The frequency f1 signal transmitted from each carriage 4 is first received by the control unit 7. If the intended location of the signal is another carriage 4, the control unit 7 transmits the signal using frequency f2 to that carriage 4. Accordingly, communication between carriages 4 is carried out by way of the control unit 7.

Figure 2:
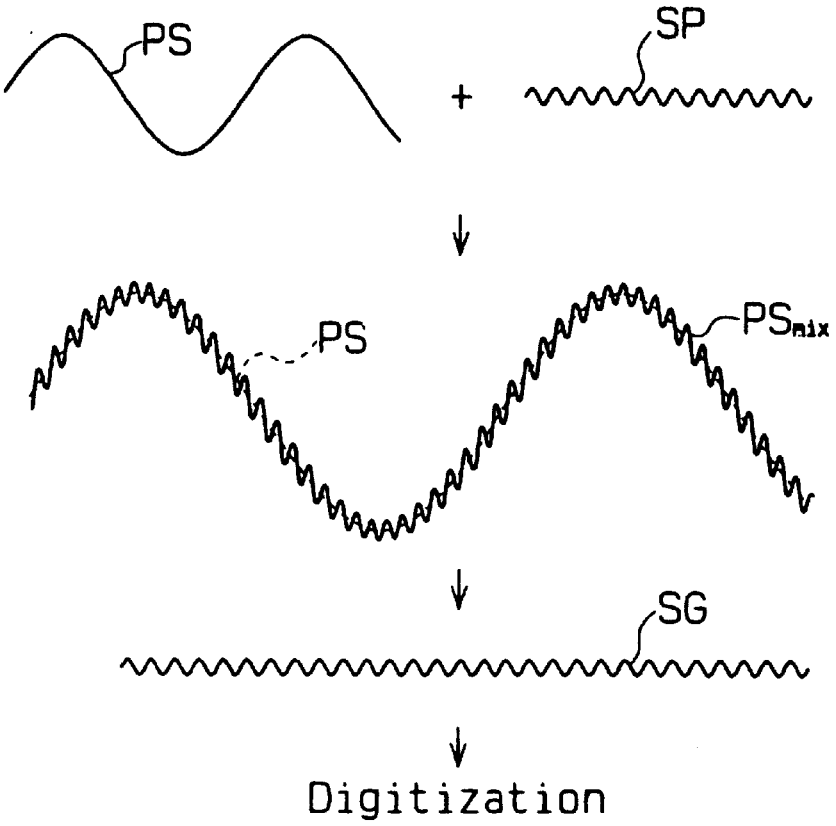
FIG. 2 is an explanatory diagram illustrating the superimposition of signals.

FIG. 2 illustrates how the signals are superimposed on the alternating current flowing through the cable 5. The electric power source 6 supplies the cable 5 with high frequency alternating current PS (e.g., 10 kHz). A transmission signal SP having a frequency of several hundred MHz, preferably 200 to 300 MHz, is superimposed on the high frequency current PS to generate the high frequency current $PS_{mix}$. High frequency current having a waveform corresponding to the high frequency current $PS_{mix}$ is induced by the reception antenna coils when receiving signals. The modems extract and digitize signal SG, which has a frequency of f1 or f2 (several hundred MHz, preferably 200 to 300 MHZ), from the induced high frequency current.

Each carriage 4 has a sensor that detects dogs (neither are shown), which are provided at a number of locations along the rail 3. The carriage 4 is also provided with a counter (not shown) that counts the rotations of an output shaft of its motor 16. The carriage 4 accurately keeps track of its position along the rail 3 by correcting the value of the counter each time the sensor detects a dog. The position of each carriage 4 is confirmed by other carriages 4 through a position signal periodically output from each carriage 4. When the carriage 4 acknowledges the possibility of a collision with another carriage 4, the carriage 4 exchanges signals with that carriage 4 to avoid collision.

Figure 3:
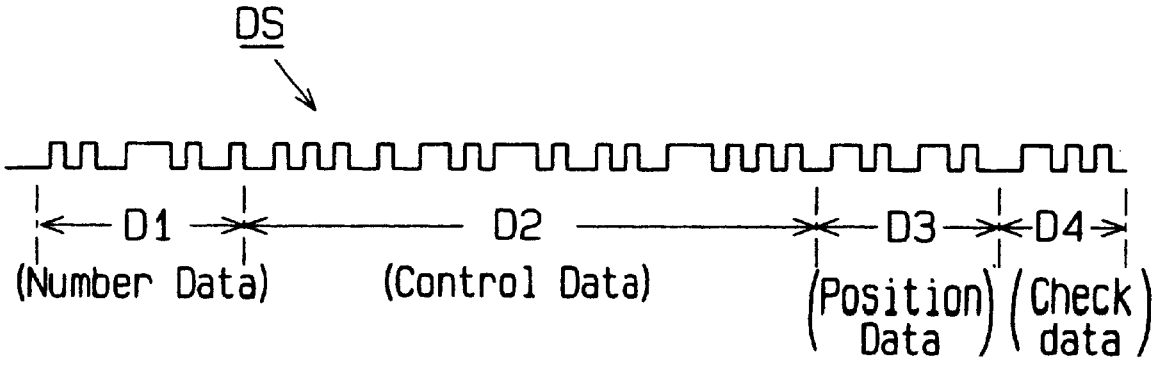
FIG. 3 is a diagrammatic view showing the signal data.

The form of the signal DS (digital signal) output from each carriage 4 and used for communication is shown in FIG. 3. The data DS includes identification number data D1, control data D2, position data D3, and check data D4. The carriage number data D1 indicates the identification number of the carriage 4 transmitting the signal DS. An identification number is designated for each carriage 4 (e.g., number one, number two, etc.). The control data D2 includes the information that is to be sent to the intended recipient. For example, when there is a possibility of collision, the control data D2 is exchanged between the carriages 4. In this case, the control data D2 includes information required to avoid collision such as comparison data used to judge priority and command data used to stop (or place in a standby state) the carriages 4. When the intended recipient of the control data D2 is one of the carriages 4, data indicating the identification number of that carriage 4 is included in the control data D2. The position data D3 indicates the present position of the carriage 4. The check data D4 is used to determine whether or not the signal DS has been accurately recognized by the intended recipient. Such data may be sum check data, which is generally used to determine the accuracy of data.

Figure 4:
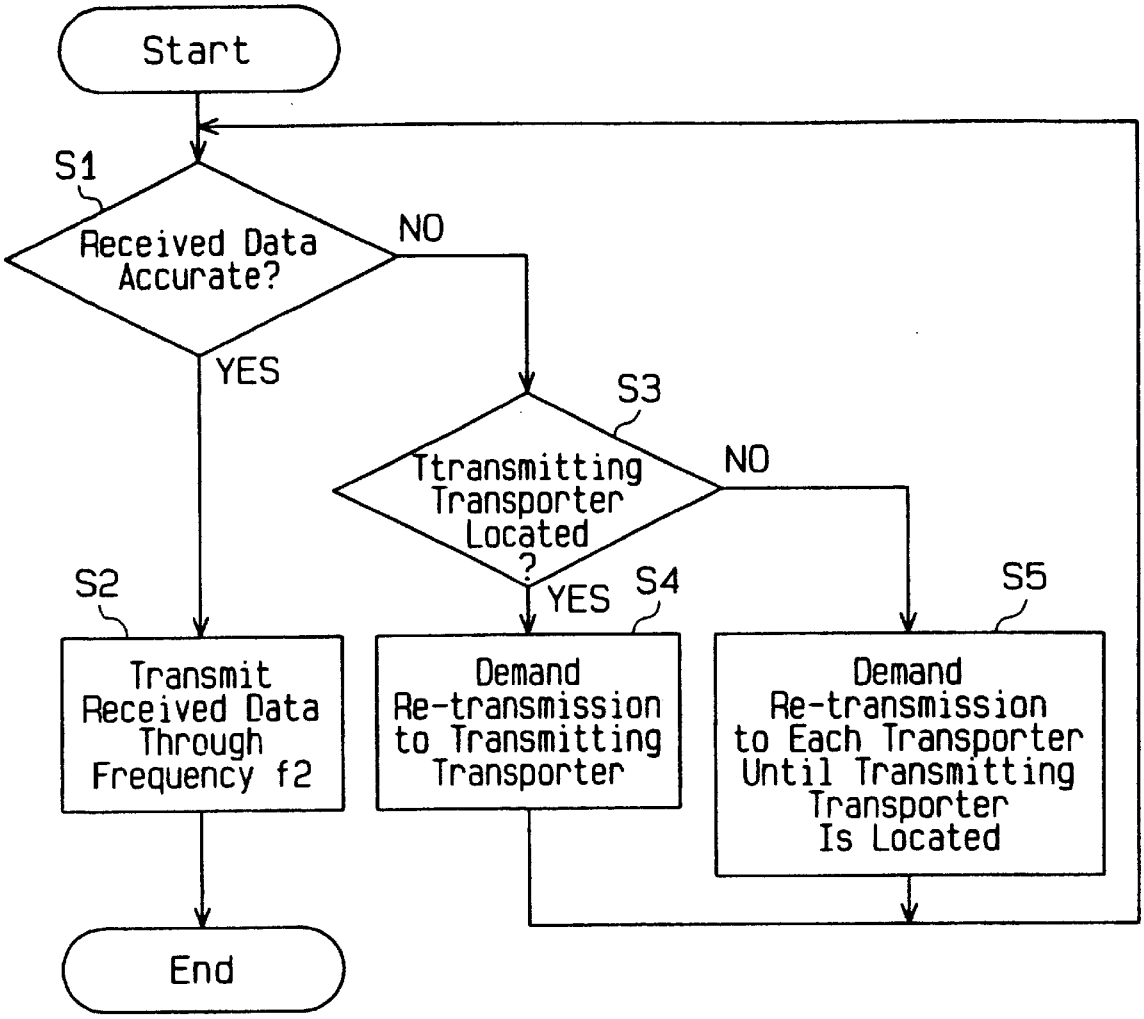
FIG. 4 is a flowchart showing the steps executed to relay signals.

As shown in FIG. 1, the controller 7*a*, which constitutes the control unit 7, includes a central processing unit (CPU) 24 and a memory 25. The CPU 24 executes various communication programs stored in the memory 25. The CPU 24 receives signals and determines the intended recipient of the signals. If the intended recipient of the signals is one of the carriages 4, a processing illustrated in FIG. 4 is executed to relay the signal. The program used to relay the signals is stored in the memory 25.

The communication steps in the transport system 1 will now be described.

The electric power source 6 supplies the cable 5 with high frequency current $PS_{mix}$ when the transport system is operating. In each carriage 4, the power source circuit 23 rectifies and decreases the voltage of the electromotive force, which is induced from the high frequency current $PS_{mix}$ by the feeder coil 17. The current processed by the power source circuit 23 is used to drive the motor 16 and the CPU 22 of the carriage 4. The controller 7*a* produces command data that is used to control each carriage 4 in accordance with operation data that is input into the input apparatuses provided at certain stations. The command data is then transmitted through command signals to the carriage 4 that is to be communicated with. When the recipient carriage 4 receives the command signals from the controller 7*a*, the associated CPU 22 controls the motor 16 and other parts in correspondence with the signal to perform the instructed operation. Each carriage 4 also transmits signals to the control unit 7. From these signals, the controller 7*a* confirms the state of the carriages 4. Thus, if transportation of an article is required, the controller 7*a* selects a carriage 4 that is in a standby state and orders the carriage 4 to transport an article.

Each carriage 4 periodically transmits a signal that indicates its location. When one of the carriages 4 confirms the location of the other carriages 4 through this signal, the carriage 4 compares its location with that of the other carriages 4 and determines the possibility of a collision. If it is determined that there is a possibility of a collision with a certain carriage 4, the carriage 4 exchanges signals with that carriage 4 to avoid collision.

The signals transmitted from each carriage 4 are produced in the associated CPU 22. As shown in FIG. 3, the CPU 22 produces signal (data) DS that include the carriage number data D1, control data D2, position data D3, and check data D4. The associated modem 21 converts the signal DS into signal SP (analog signal) having frequency f1 . The signal SP having frequency f1 is transmitted from the transmission antenna coil 18 and is superimposed on the high frequency current PS flowing through the cable 5. The signal SP having frequency f1 is not received by other carriages 4 and is received only by the controller 7*a*.

When the high frequency current $PS_{mix}$, on which the signal SP having frequency f1 is superimposed, is received by the receptor antenna coil 8*b*, it induces high frequency current having a waveform corresponding to the high frequency current $PS_{mix}$. The modem 20 then extracts the signal component SG having frequency f1 from the induced high frequency current. The signal component SG is returned to signal DS, which is a digital signal, and sent to the CPU 24. The CPU 24 then determines the intended recipient of the signal DS from control data D2, which is information included in the signal DS. If it determined that the intended recipient is one of the carriages 4, the CPU 24 relays the signal as shown in the flowchart of FIG. 4.

The signal relay steps will now be described with reference to FIGS. 4 and 5. In step S1, the CPU 24 determines whether or not the received data DS is accurate. That is, the CPU 24 adds the number of bits of the data DS, which is formed as shown in FIG. 3. Sum checking is carried out by comparing the sum with the check data D4. If it is determined that the received data DS is accurate, the CPU 20 proceeds to step S2. At step S2, the modem 20 converts the received data DS to a signal having frequency f2 and transmits the converted signal. If it is determined that the received data DS is not accurate in step S1, the CPU 24 proceeds to step S3.

In step S2, the modem 20 converts the data DS into a frequency f2 signal (analog signal). The signal is then transmitted from the transmission antenna coil 8*a*. This superimposes the frequency f2 signal on the high frequency current PS. The frequency f2 signal is then received by the carriage 4, which is the intended recipient. That is, the receptor antenna coil 19 of the carriage 4 induces high frequency current having a waveform corresponding to the high frequency current $PS_{mix}$. The modem 21 of the carriage 4 extracts the signal component having frequency f2 from the induced high frequency current and returns the signal component to signal DS, which is a digital signal. The signal DS is then input into the CPU 22.

Although the transmission antenna coil 18 of each carriage 4 is arranged in the vicinity of the cable 5, the antenna coil 18 and the cable are separated from each other. Thus, the frequency f1 signals transmitted from the transmission antenna coil 18 of the carriage 4 are attenuated significantly and become weak when superimposed on the high frequency current PS flowing through the cable 5. On the other hand, the transmission antenna coil 8*a* of the control unit 7, which serves as a fixed station, is directly wound about the cable 5. Thus, the attenuation of the frequency f2 signal transmitted from the antenna coil 8*a* and superimposed on the high frequency current PS is small.

Figure 5:
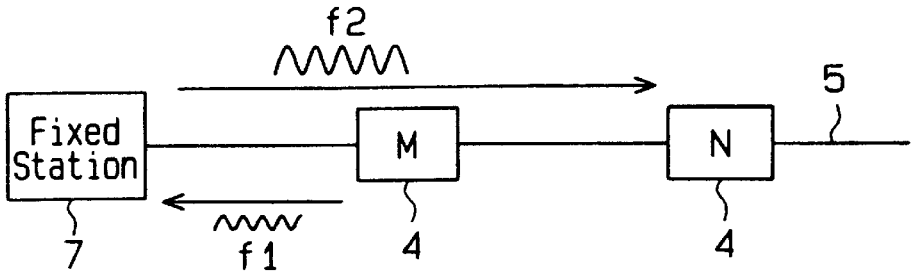
FIG. 5 is a schematic view illustrating communication between transporters.

Accordingly, as shown in FIG. 5, when the carriage 4 denoted as M transmits a frequency f1 signal and the carriage 4 denoted as N receives the frequency f2 signal via the control unit 7, which serves as a fixed station, the strength of the frequency f2 signal transmitted from the control unit 7 is greater than that of the frequency f1 signal received by the control unit 7. Thus, the transmission between carriage M and carriage N is accurate. This prevents the recipient carriage 4 from erroneously recognizing signals and enhances the reliability of communication between carriages 4.

If it is determined that the received data DS is not accurate in step S1, the CPU 24 proceeds to step S3 and determines whether or not the carriage 4 from which the data DS originated can be located. That is, the CPU 24 confirms whether it is possible to read the identification number data D1 included in the data DS. If the identification number data D1 can be read, the CPU 24 proceeds to step S4 and demands re-transmission of the data DS to the carriage 4 designated with the identification number that was read in step S3. If the carriage 4 from which the data DS originates cannot be located in step S3, the CPU 24 proceeds to step S5.

At step S5, the CPU 24 demands re-transmission of the data DS from each carriage 4. The demand is first sent to the carriage 4 that had transmitted data DS immediately before the present data DS (the origin of which is unknown) was received. The demand is then sent to the carriage 4 that is designated with the succeeding identification number. Thereafter, the demand is sent out in an orderly manner to each carriage 4 until the CPU 24 locates the carriage 4 that transmitted the data DS being sought. When the sought carriage 4 re-transmits the data DS, the CPU 24 returns to step S1 and repeats the same steps. If it is determined that the re-transmitted data DS is accurate in step S1, the CPU 24 transmits the data DS to the intended carriage 4 using frequency f2 in step S2. If it is determined that the data DS is not accurate, the CPU 24 demands re-transmission once again to the carriage 4 from which the data DS originated as necessary in steps S3–S5. The CPU 24 repeats the necessary steps until the data DS is accurately received.

Accordingly, if the control unit 7 (fixed station) does not accurately receive data DS from one of the carriages 4 due to the weak frequency f1 signal, the CPU 24 demands re-transmission of the data DS to the carriage 4 until the data DS is accurately received. This further enhances the reliability of communication between carriages 4.

Communication between the carriages 4 is carried out through the control unit 7. Weak signals are transmitted from the transmission antenna coil 18 of each carriage 4 and superimposed on the high frequency current PS flowing through the cable 5. However, the weak signals are substantially amplified when re-transmitted from the control unit 7 by the transmission antenna coil 8*a*, which is directly wound about the cable 5. Hence, although the transmission antenna coil 18 and the receptor antenna coil 19 of each carriage 4 do not contact the cable 5, communication signals exchanged between the carriages 4 are amplified by the control unit 7 before being received by the intended carriage 4. This prevents erroneous recognition of data at the recipient carriage 4.

The control unit 7 has a check function that determines whether or not the received data DS is accurate. If the data DS is not received accurately, the control unit 7 demands the data DS to be re-transmitted from the carriage 4 from which the data originated. Therefore, only accurate data is received by the recipient carriage 4. Accordingly, the signal transmitted from the control unit 7 is always accurate even if noise enters the weak frequency f1 signal during transmission of the signal or even if the frequency f1 signal is too weak to be received by the control unit 7. This further enhances reliability of communication carried out between carriages 4. Since the frequency f2 signal transmitted from the control unit 7 is strong, the influence of noise on the frequency f2 signal is relatively small.

The enhanced reliability of communication between the carriages 4 enables communication over a long distance. Thus, longer rails 3 may be used. In other words, the length of the rail 3 is not significantly restricted by communication capabilities.

Erroneous data is not received by the carriages 4. Thus, problems caused when receiving erroneous data, such as stoppage of the entire system, is prevented.

The frequency f1 of the signal transmitted from each carriage 4 differs from the frequency f2 of the signal transmitted from the control unit 7. Thus, the carriages 4 and the control unit 7 are capable of transmitting and receiving signals simultaneously. This increases the amount of communication data per unit time.

It should be apparent to those skilled in the art that the present invention may be embodied in many other specific forms without departing from the spirit or scope of the invention. More particularly, the present invention may be modified as described below.

The fixed station is not limited to an apparatus such as the control unit 7 that controls the operation of carriages. For example, the fixed station may be an amplifier, which merely amplifies signals, or an amplifier provided with a microcomputer that is capable of checking data. The fixed station may also be any apparatus that enhances the reliability of communication between carriages.

In the illustrated embodiment, the antenna coils 8*a*, 8*b* of the fixed station are directly wound about the cable 5. However, the coils 8*a*, 8*b* need not be wound directly about the cable 5 and may be arranged in the vicinity of the cable 5. In this case, the number of windings of each antenna coil or the magnitude of the transmitted signal may be changed to an appropriate value. This enables the received signals to be superimposed on the current flowing through the cable 5 in an amplified state.

The relaying of signals through the fixed station may be determined by the distance between communicating carriages. That is, if the distance is long, communication may be carried out through the fixed station and, if the distance is short, communication may be carried out directly between the carriages. In this case, when direct communication is carried out between carriages, a signal having a frequency that will be received accurately is used. The relaying of signals may also be determined by comparing the distance between the communicating carriage and the fixed station or the distance between the communicating carriages. In this case, either direct communication or relay communication is selected by judging which method of communication is more capable of preventing signal attenuation. Since the more reliable communication method is selected, the amount of communication data per unit time is increased.

In the illustrated embodiment, sum check is performed to locate erroneous signals (data). However, a correction code may be used by the CPU 24 to correct erroneous data. This enables data corrected by the CPU 24 to immediately be transmitted to the intended carriage 4. As another option, the waveforms of analog signals may be reformed before digitization to avoid erroneous receiving of signals.

The signals transmitted from the carriages and the signals transmitted from the fixed station may have the same frequency. In this case, a relay code is inserted into the signal transmitted from the fixed station so that the carriages can acknowledge the signal.

Although two antenna coils are employed by the fixed station in the illustrated embodiment, a single antenna coil that transmits and receives signals may be employed instead.

The present invention may be applied to a communication system for carriages that travel along a rail extending along the ground. For example, communication may be carried out by superimposing signals on current flowing through a cable used to send power to an unmanned carriage traveling along rails that extend along the ground or stacker cranes of an automatic storehouse. In this case, communication between the carriages or communication between the stacker cranes may be carried out by relaying signals through a fixed station.

The application of the present invention is not only applied to carriages that carry articles in factories or storehouses. The present invention may be employed with any kind of carriage communication system that generates electric power through electromotive induction of the cable.

Therefore, the present examples and embodiments are to be considered as illustrative and not restrictive and the invention is not to be limited to the details given herein, but may be modified within the scope of the appended claims.

What is claimed is:

1. A communication system for a plurality of movable bodies that travel along a rail, said communication system comprising:

a cable extended along the rail, wherein the cable is used to transmit electric current that drives the movable bodies and is used for carrying information between the movable bodies, and wherein the movable bodies communicate with one another by superimposing communication signals on the current flowing through the cable to transmit the information and by extracting communication signals from the current flowing through the cable to receive the information;

a fixed station that relays communication signals between different ones of the movable bodies by amplifying communication signals received by the fixed station from the cable, wherein the fixed station has a fixed station antenna wound around the cable that detects communication signals transmitted from the movable bodies at a first predetermined frequency, the fixed station amplifies the communication signals, and the fixed station antenna returns the amplified signals to the cable; and a movable body antenna connected to each movable body for superimposing communication signals generated by the movable body onto the current flowing in the cable and for detecting the amplified communication signals superimposed on the current flowing in the cable by the fixed station, wherein the movable body antenna is spaced from the cable by a predetermined distance.

2. The communication system according to claim 1, wherein the communication signals include a first signal type and a second signal type, each of the first and second signal types having a different frequency, the movable bodies transmitting the information by superimposing communication signals of the first signal type on the current flowing through the cable and receiving the information by extracting communication signals of the second signal type from the current flowing through the cable, and wherein the fixed station includes a means for converting signals of the first signal type received from the cable to signals of the second signal type, the converted signals of the second signal type being returned to the cable from the fixed station.

3. The communication system according to claim 1, wherein the fixed station antenna includes a coil wound directly about the cable.

4. The communication system according to claim 1, wherein the fixed station includes a means for determining whether or not communication signals received from the cable are accurate, wherein the fixed station returns the amplified communication signals to the cable when the determining means determines that the received communication signals are accurate.

5. The communication system according to claim 4, wherein the fixed station includes a means for demanding re-transmission of a received communication signal from the movable body that transmitted the received signal when the determining means determines that the received communication signal is not accurate.

6. A communication system for a plurality of movable bodies that travel along a rail, said communication system comprising:

a cable extended along the rail, wherein the cable is used to transmit electric current that drives the movable bodies and is used for carrying information between the movable bodies, and wherein the movable bodies communicate with one another by superimposing communication signals on the current flowing through the cable to transmit the information and by extracting communication signals from the current flowing through the cable to receive the information;

a fixed station that receives and relays communication signals between communicating movable bodies, wherein the fixed station amplifies communication signals received from the cable;

a fixed station antenna coil provided in the fixed station, the fixed station antenna coil being directly wound about the cable, wherein the fixed station relays the communication signals by receiving signals transmitted from the movable bodies with the fixed station antenna coil, amplifying the signals, and returning the amplified signals to the cable with the fixed station antenna coil; and a movable body antenna coil provided in each movable body to transmit communication signals to the cable and to receive signals from the cable, the movable body antenna coil being arranged in the vicinity of, without contacting, the cable.

7. The communication system according to claim 6, wherein the fixed station includes a means for determining whether or not communication signals received from the cable are accurate, wherein the fixed station returns the amplified communication signals to the cable when the determining means determines that the received communication signals are accurate.

8. The communication system according to claim 7, wherein the fixed station includes a means for demanding re-transmission of a received communication signal from the movable body that transmitted the received signal when the determining means determines that the received communication signal is not accurate.

9. The communication system according to claim 6, wherein the communication signals include a first signal type and a second signal type, each of the first and second signal types having a different frequency, the movable bodies transmitting the information by superimposing communication signals of the first signal type on the current flowing through the cable and receiving the information by extracting communication signals of the second signal type from the current flowing through the cable, and wherein the fixed station includes a means for converting signals of the first signal type received from the cable to signals of the second signal type, the converted signals of the second signal type being returned to the cable from the fixed station.

10. A communication system for a plurality of movable bodies that travel along a rail, said communication system comprising:

a cable extended along the rail for transmitting electric current used to drive the movable bodies;

a fixed station including, a transmission antenna coil wound around the cable for superimposing a current having a first predetermined frequency onto the electric current flowing along the cable, a reception antenna coil wound around the cable for detecting a current having a second predetermined frequency superimposed on the electric current flowing along the cable, and a controller, connected to the transmission antenna coil and the reception antenna coil, that generates digital signals, converts the generated digital signals to alternating current having the first predetermined frequency, and sends the alternating current having the first predetermined frequency to the transmission antenna coil, and receives the detected current having the second predetermined frequency from the reception antenna coil and converts the detected current to a digital signal; and each movable body including, at least one pickup apparatus maintained a predetermined distance from the cable, the pickup apparatus including a feeder coil, a transmission coil and a receptor coil, wherein the feeder coil generates induced emf from the current flowing along the cable to drive the movable body, the receptor coil detects current having the first predetermined frequency superimposed on the electric current flowing along the cable, and the transmission coil superimposes an information signal having the second predetermined frequency onto the electric current flowing along the cable, and a processor connected to the receptor coil and the transmission coil, the processor generating the information signal having the second predetermined frequency, receiving the detected current having the first predetermined frequency, converting the detected current to a digital signal and decoding the digital signal, wherein the processor controls the movement of the movable body in response to the decoded digital signal.

11. The communication system according to claim 10, wherein the pickup apparatus has a generally E-shaped cross-section having a center projection, the projection having a coil wound thereabout, the coil including the feeder coil, the transmission coil and the receptor coil.

12. The communication system according to claim 11, wherein the movable body transmission coil is arranged closer to the cable than the receptor coil.

13. A communication system for a plurality of movable bodies that travel along a rail, said communication system comprising:

a cable extended along the rail, wherein the cable is used to transmit electric current that drives the movable bodies and is used for carrying information between the movable bodies, and wherein the movable bodies communicate with one another by superimposing communication signals on the current flowing through the cable to transmit the information and by extracting communication signals from the current flowing through the cable to receive the information;

a fixed station that relays communication signals between different ones of the movable bodies by amplifying communication signals received by the fixed station from the cable, wherein the fixed station has a first antenna wound around the cable that detects communication signals transmitted from the movable bodies at a first predetermined frequency, the fixed station amplifies the communication signals, and the fixed station has a second antenna wound around the cable that returns the amplified signals to the cable;

a transmission antenna connected to each movable body for superimposing communication signals generated by the movable body onto the current flowing in the cable; and a receptor antenna connected to each movable body for detecting the amplified communication signals superimposed on the current flowing in the cable by the fixed station, wherein the transmission antenna and the receptor antenna are spaced from the cable by respective predetermined distances.

* * * * *